United States Patent [19]

Johnson et al.

[11] Patent Number: 4,621,878

[45] Date of Patent: Nov. 11, 1986

[54] KNOCK-DOWN MERCHANDISE DISPLAY FIXTURE

[75] Inventors: John A. Johnson; Edward O. Gandolf, both of Strongsville; Stephen N. Hardy, Copley, all of Ohio

[73] Assignee: American Greetings Corporation, Cleveland, Ohio

[21] Appl. No.: 710,430

[22] Filed: Mar. 11, 1985

[51] Int. Cl.[4] ..... A47F 3/14

[52] U.S. Cl. ..... 312/257 R; 312/258; 312/117; 312/330 R; 211/55; 211/128; 211/132; 211/195

[58] Field of Search ..... 312/117, 128, 333, 330 R, 312/357 R, 258; 211/55, 128, 132, 189, 195, 99, 100; 248/246, 222.3

[56] References Cited

U.S. PATENT DOCUMENTS

| | | | |
|---|---|---|---|
| 90,107 | 10/1869 | Hayfield . | |
| 1,084,378 | 1/1914 | Wall . | |
| 2,236,627 | 4/1941 | McWhirter . | |
| 2,279,864 | 4/1942 | Eide . | |
| 2,992,745 | 7/1961 | Huff . | |
| 3,033,639 | 5/1962 | Emery | 312/348 |
| 3,044,674 | 7/1962 | Levy | 211/99 |
| 3,197,265 | 7/1965 | Rand . | |
| 3,200,961 | 8/1965 | Kolster et al. . | |
| 3,290,107 | 12/1966 | Kolster . | |
| 3,302,797 | 2/1967 | Kolster . | |
| 3,394,973 | 7/1968 | Scott . | |
| 3,515,451 | 6/1970 | Hickey . | |
| 3,549,019 | 12/1970 | Wood et al. . | |
| 3,572,874 | 3/1971 | Hamel . | |
| 3,667,826 | 6/1972 | Wood et al. . | |
| 3,729,246 | 4/1973 | Harrell et al. . | |
| 3,880,390 | 4/1975 | Niven | 248/222.3 |
| 3,908,830 | 9/1975 | Skrzelowski | 211/55 |
| 3,933,402 | 1/1976 | Peterson | 312/330 |
| 3,963,913 | 6/1976 | Donovan et al. . | |
| 4,222,542 | 9/1980 | Wilson et al. . | |
| 4,256,422 | 3/1981 | Theissig et al. . | |
| 4,360,281 | 11/1982 | Alsup, Jr. et al. . | |

*Primary Examiner*—Francis K. Zugel
*Assistant Examiner*—Joseph Falk
*Attorney, Agent, or Firm*—Baldwin, Egan & Fetzer

[57] ABSTRACT

A fabricated, knock-down merchandise display fixture which includes a base having forwardly disposed generally vertically extending spaced structural arms mounted in coupled relation to the base, generally adjacent the forward boundary of the base, and extending upwardly relative to the base, with the arms being adapted to provide structural support for the merchandise display deck of the fixture, and with the coupling of the arms providing for folding of the arms relative to the base, thus decreasing the overall height of the base and arms and facilitating shipment of the fixture in knock-down condition. A drawer structure adapted for being disposed in sliding condition on the base, is provided with the drawer including a removable front panel with a rotatable cam lock for detachably securing the front panel to the drawer. The general idea is to simplify the assembly and skill necessary to assemble the fixture at the site of use, while facilitating shipment of the fixture to the site.

22 Claims, 19 Drawing Figures

10
12
12a
12b
12c
14
16a
19
20
20a
22
24
26
28
28a
28b
30
32
34
34a
35
35a
36
36a
38
38a
38b
42
42a
44
44a
46
50
56
56a
72
72a
74
74a
76
84
98

KNOCK-DOWN MERCHANDISE DISPLAY FIXTURE

The present invention relates in general to fabricated display fixtures or racks, for displaying merchandise, and which includes a base structure adapted to support a merchandise display deck for supporting the merchandise, such as, for instance, greeting cards, ribbon, wrapping paper or the like, with the base being adapted to house a slidable drawer thereon for storing merchandise for eventual display on the deck of the fixture. The base includes upwardly extending structural arms which are adapted to provide support for the deck, with the arms being foldable for decreasing the overall height of the base structure, thus facilitating shipment of the fixture to the site of use. Moreover, the drawer is of the knock-down variety which includes a removable front panel which is detachable from the remainder of the drawer, and which includes rotatable cam lock means for locking the front panel in place on the drawer pan.

BACKGROUND OF THE INVENTION

Fabricated display units which may be readily assembled and disassembled are known in the prior art; it is also known in the prior art to provide a display rack or fixture having foldable structure for facilitating packing of the rack for shipment; also knock-down drawers for facilitating shipment thereof and having means for locking a removable front panel to the front of the drawer structure are known in the prior art.

U.S. Pat. No. 1,084,378 discloses a display rack with foldable legs for facilitating packing of the rack for shipment. U.S. Pat. No. 96,107 discloses a clothes rack with foldable feet having a notch and projection structure for holding the feet in predetermined position. U.S. Pat. No. 2,992,745 discloses a foldable rack. U.S. Pat. No. 3,933,402 discloses a knock-down drawer including a drawer pan with a removable front panel and locking means accessible from the front of the panel, for actuation of the locking means. U.S. Pat. No. 4,222,542 discloses an end panel mount including hooks with a cantilevered spring lock associated therewith. U.S. Pat. Nos. 3,197,265, 3,572,874 and 3,729,246 disclose other arrangements of vertically oriented panels removable secured to a base by means of coupling elements.

SUMMARY OF THE INVENTION

The present invention provides an improved fabricated, knock-down merchandise display unit or fixture, which includes a base having arm structure movably coupled thereto and adapted when in upwardly extending position, to provide structural support for a merchandise display deck of the fixture, and with the arm structure being pivotable downwardly relative to its connection to the base, to a position which decreases the overall height of the base and arm, for facilitating handling and shipment of the fixture, and wherein when the fixture reaches its destination or site of use, such arm structure can be readily pivoted relative to the base, to an upright position for assembly of the fixture, and without the need of special tools or highly skilled labor to assemble the fixture.

The invention also provides a knock-down drawer for slidable mounting on the base for storing merchandise therein pending its transfer to the merchandise display deck of the fixture, and wherein the drawer includes a separable front panel for facilitating shipment of the drawer, and which includes rotatable cam lock means for detachably securing the front panel to the remainder of the drawer pan.

Accordingly, an object of the invention is to provide a merchandise display fixture which is of fabricated construction and which can be expeditiously assembled and disassembled, utilizing relatively unskilled labor and a minimum of tools, and which includes a base and pivotal arm structure which can be collapsed to decrease the overall height thereof for facilitating shipment to the site of use of the fixture.

Another object of the invention is to provide a merchandise display fixture of the latter mentioned type wherein the collapsible or downwardly swingable arm structure includes slot and projection means thereon which enables the arm to be locked in its upright position relative to the base and which provides for the rapid downward swinging movement or collapse of the arm relative to the base when disassembly of the fixture is desired.

A still further object of the invention is to provide a merchandise display fixture of the aforementioned type which includes a knock-down type drawer adapted to be mounted in slidable relation on the base of the fixture, and wherein the drawer comprises a removable front panel which provides the forward wall of the drawer, and wherein a rotatable cam lock means is provided for detachably securing the front panel to the remainder of the drawer structure, whereby the front panel can be rapidly assembled with the drawer structure and locked in position thereon, or disassembled from the drawer.

A still further object of the invention is to provide a knock-down merchandise display fixture in accordance with the above wherein the merchandise display deck of the fixture is a molded article of relatively lightweight material such as, for instance, plastic, and wherein the deck can be readily assembled between the rear and front support portions of the fixture without the need of special tools or skilled labor.

Other objects and advantages of the invention will be apparent from the following description taken in conjunction with the accompanying drawings, wherein:

BRIEF DESCRIPTION OF THE DRAWINGS

FIG. 8 is an exploded, fragmentary view showing the assembly of side panels to the base and rear uprights of the fixture;

FIG. 9 is a fragmentary illustration of the assembly of a divider wall panel with the merchandise display deck of the fixture to provide defined cubicles for receiving merchandise and holding the latter on the display deck;

DESCRIPTION OF PREFERRED EMBODIMENT

Figures 2, 3, 4:
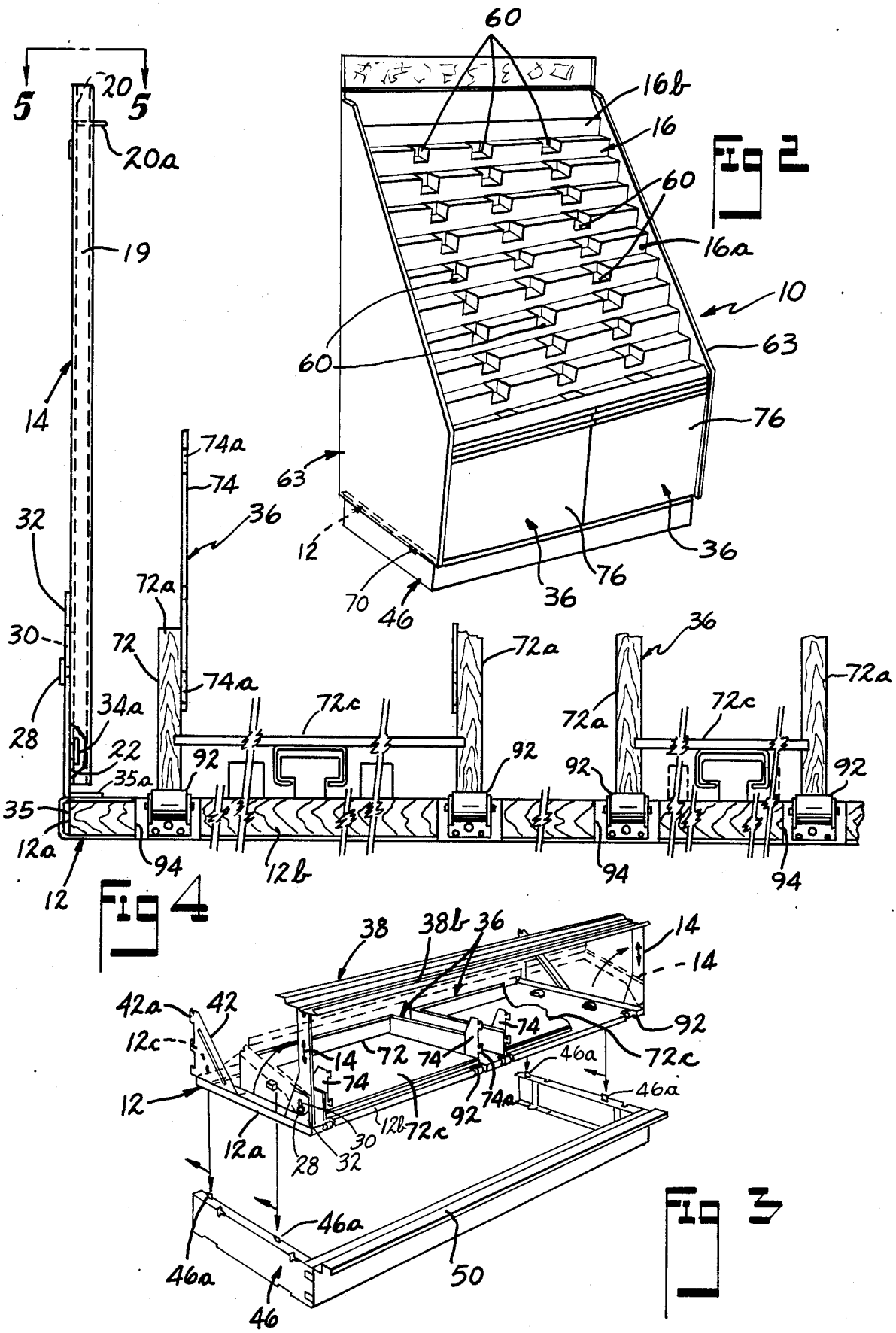
FIG. 2 is a generally diagrammatic, perspective illustration of one form of merchandise display unit embodying the present invention.
FIG. 3 is a fragmentary, reduced size, exploded view of the base and foldable arm structure and with the knock-down drawer structure having the front panels thereof removed, and with such base-arm and drawer structure ready for positioning on a conventional kick-plate support to mount the display fixture on a floor surface.
FIG. 4 is an enlarged fragmentary, front end, broken, elevational view of the base-arm and drawer structure of FIG. 3.

The specific display fixture or cabinet illustrated in the drawing, as for instance, in FIG. 2, is a fixture adapted for merchandising products such as greeting cards, gift wrapping (e.g. ribbons and bows, wrapping paper and the like) but it will be understood that the fixture of the invention is not limited to such specific products or merchandise, but is also adapted for use with other types and kinds of merchandise. The fixture is of the knock-down type adapted to be shipped to the site of ultimate use and to be assembleable on site, using relatively unskilled labor, and requiring a minimum of tools and separate fastening devices. By providing for shipment of the unit in sectional form, the transfer of the unit to the site of use and its assembly thereat, and its disassembly, if that becomes necessary or desirable, for moving the fixture to another location, is facilitated.

Figure 7:
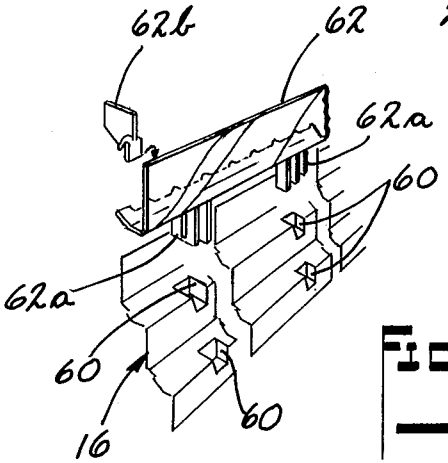
FIG. 7 is a perspective illustration showing the assembly of the fixture, and particularly the merchandise display deck of the fixture with the back wall uprights thereof, preparatory to inserting the front end of the molded merchandise display deck into the cross member supported on the foldable arms of the base of the fixture.
Figure 6:
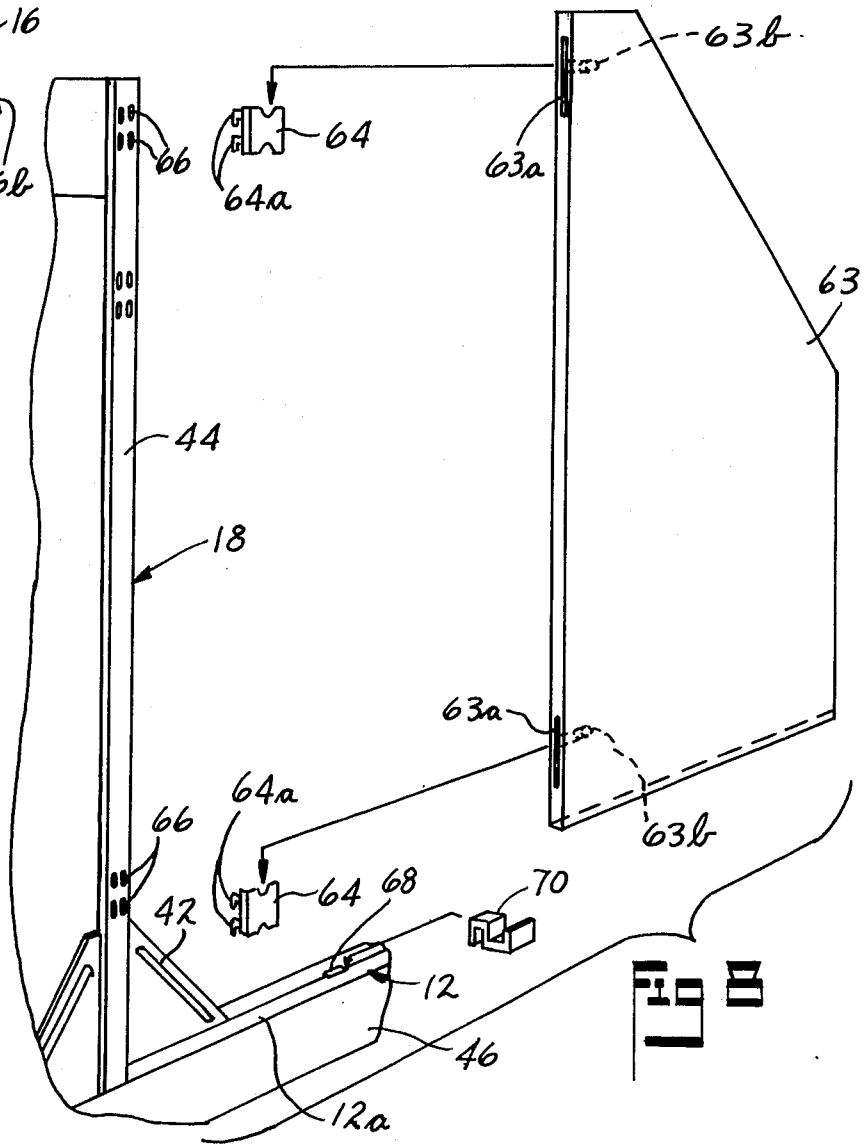
Figure 7:
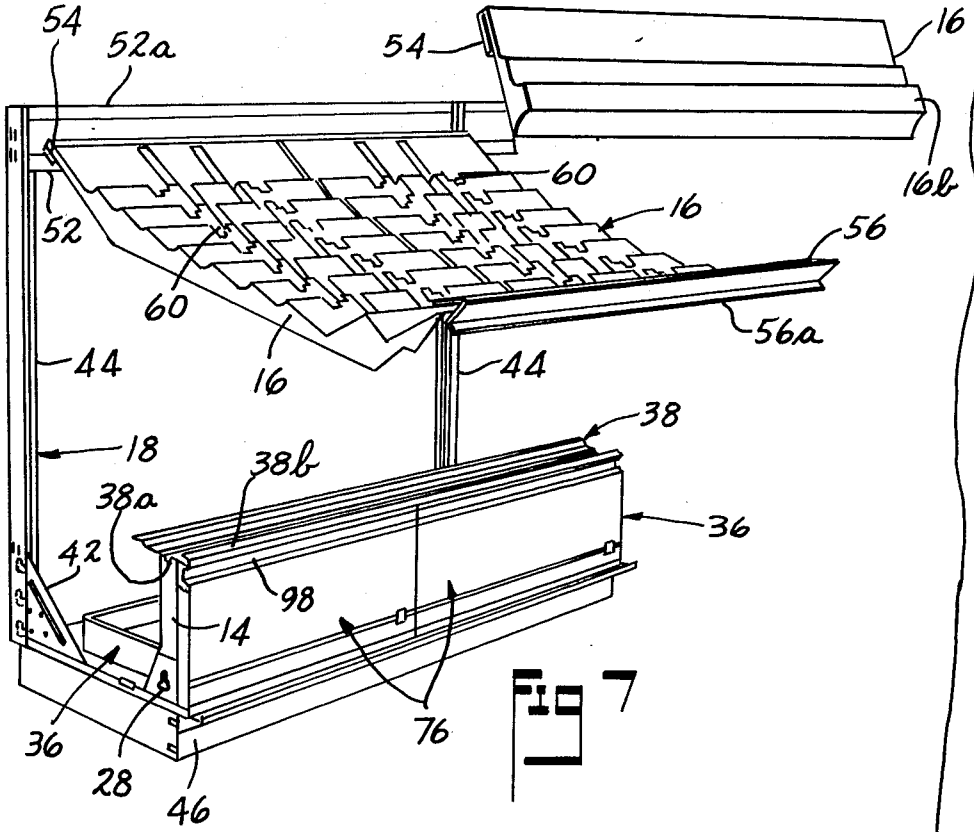

The merchandising fixture or cabinet is designated by the reference number 10 and may conventionally include a base structure 12 (FIGS. 1 and 2) which in the embodiment illustrated is of generally rectilinear configuration in plan (FIGS. 3 and 7) and which may include generally linear side members 12*a* connected by front and rear generally linear members 12*b*, 12*c*.

Movably coupled to the base 12, generally adjacent the forward boundary thereof, are a pair of spaced, generally vertically extending arm members 14, which are adapted to provide structural support for the merchandise display deck 16 (FIGS. 2 and 7) of the fixture 10. Display deck 16 is preferably formed of molded plastic (in the embodiment illustrated fashioned in two sections 16*a* and 16*b*) and is adapted to be supported from the rear wall structure 18 of the fixture and the aforementioned arm structure 14, and as will be hereinafter described in greater detail.

Figures 1, 1A:
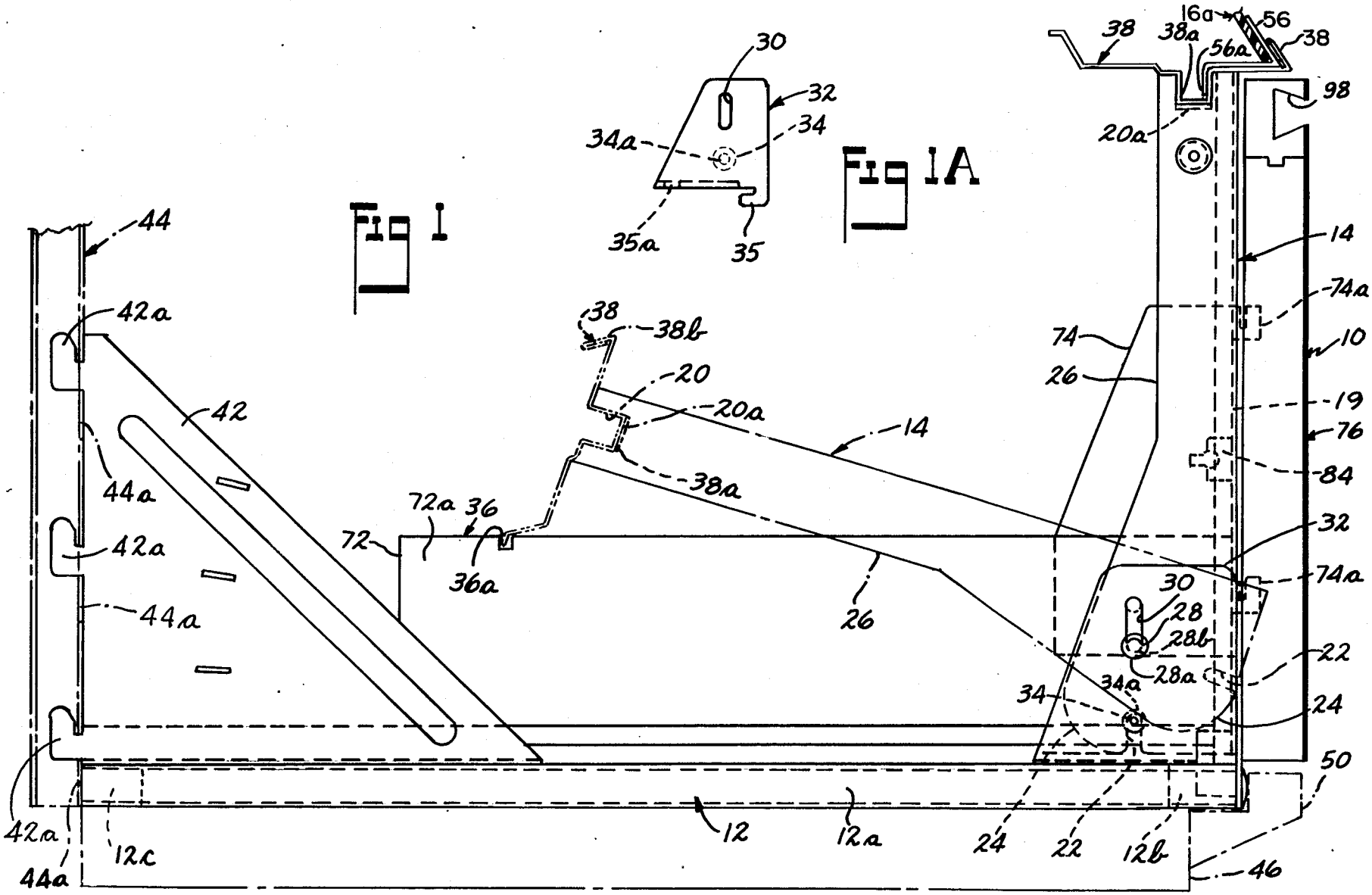
FIG. 1 is an enlarged, side elevational view of the base portion and an associated vertically oriented arm disposed in upright position for providing structural support for the merchandise display deck of the fixture; in phantom lines there is illustrated the fold-down position of the arm; the slidable knock-down drawer of the fixture is also shown in this view.
FIG. 1A is a side elevational view of the separable mounting web adapted for securement to the base of the fixture adjacent the front boundary of the latter, for swingably mounting the associated arm on the base as illustrated in FIG. 1.

Each of the arms 14 is preferably formed of sheet-like material, such as, for instance sheet metal, and may include at the forward boundary thereof a bent flange section 19 (FIGS. 1 and 4) for aiding in rigidifying the respective arm. The upper end of each arm 14 preferably has a notched out section 20 formed therein with a defining laterally extending tab portion 20*a* for a purpose to be hereinafter described. The lower end portion of each arm is provided with a slot 22 which opens up onto the bottom boundary of the arm, with such bottom boundary being preferably arcuate, as at 24, providing a generally widened base for the arm, and which subsequently slopes diagonally upwardly and inwardly as shown in FIG. 1, to merge with the generally linearly extending upper section 26 of the arm.

Figure 5:
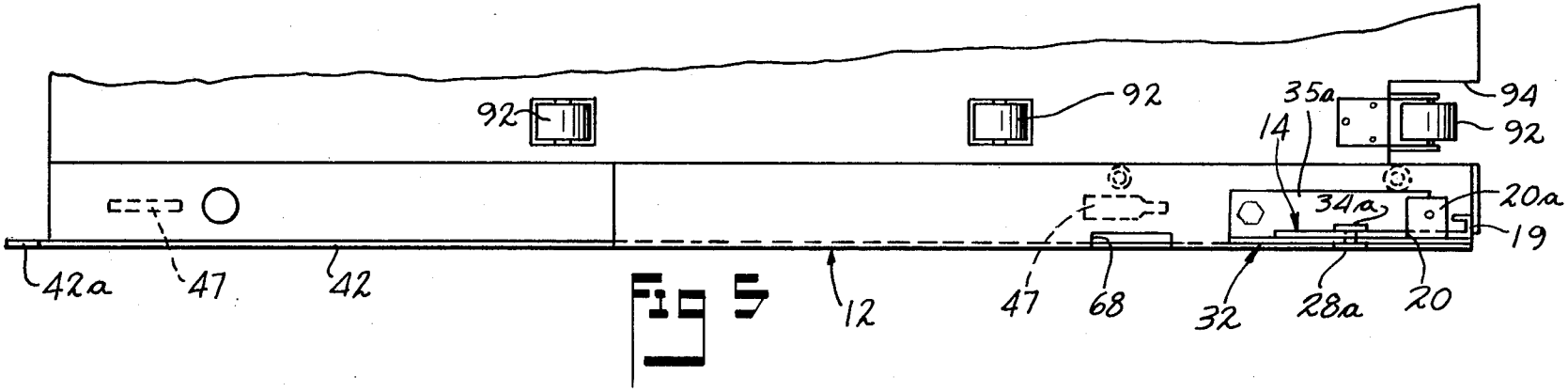
FIG. 5 is a fragmentary, enlarged, plan view taken generally along the plane of line 5—5 of FIG. 4, looking in the direction of the arrows.
Figure 6:
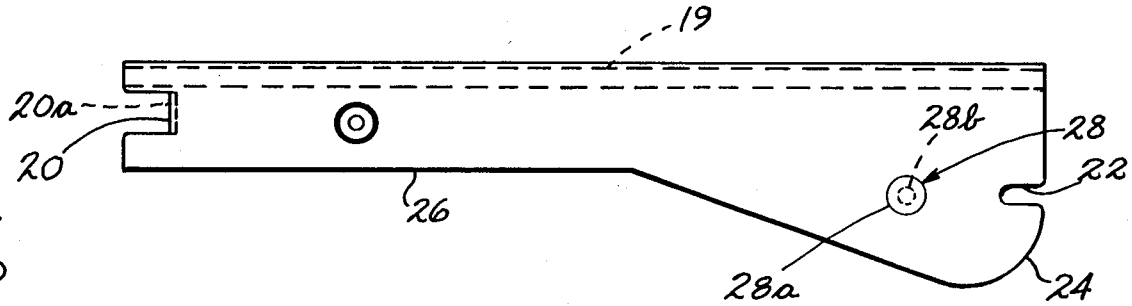
FIG. 6 is an elevational view of the lefthand arm member per se.

Arm 14 may be provided with a laterally extending projection 28 which includes a head portion 28*a* and a shank 28*b* attached to the head 28*a*, and extending laterally to be anchored to the confronting side of the respective arm 14. Headed projection 28 is adapted to pass through an elongated vertically arranged slot 30 (FIG. 1) in upstanding mounting web or bracket 32 which is preferably detachably anchored to the base 12 adjacent the forward boundary thereof, and next to the arm 14. Web 32 also includes a laterally extending projection 34 (FIGS. 1, 4 and 5) having a head 34*a* thereon, with the shank portion of the projection 34 being adapted to be received through the aforementioned slot 22 in the lower end of the arm 14, with the shank portion received in the upper end of the slot as best shown in FIG. 1. Web 32 may include depending hook 35 adapted to be interlocked into a receiving slot in base 12, and also includes lateral integral flange 35*a*, for mounting web 32 on the base 12.

It will be seen that the arm 14 is held in an upright vertically extending position by means of the retainer projection 34 extending through generally complementary slot 22 in the arm 14 and with the pivot projection 28 extending through the complementary elongated slot 30 in the mounting web 32. When it is desired to fold the arm (or arms) 14 and swing it downwardly relative to the base 12 in order to decrease the overall height of the base and arm assembly, the arm may be first lifted upwardly, thus moving the slot 22 in the lower end thereof above the shank portion of projection 34 on the mounting web, and also causing the projection 28 on the arm to be moved upwardly to the upper end of the slot 30 in the mounting web, after which the arm 14 can be readily pivoted or swung downwardly and rearwardly, with the arm riding on its arcuate base portion surface 24 to a lowered position as shown, for instance, in FIG. 1. The left and righthand arms of the base-arm assembly are preferably mirror images of one another.

In the embodiment illustrated, the base-arm assembly 12, 14 has mounted thereon a slidable knock-down drawer structure 36, with the drawer pan having slots or recesses 36*a* formed in the side walls thereof for receiving the rearward end of cross member 38 (FIG. 1) which extends between the left and right swingable arms on the base. In the upright position of the arms and cross member 38, the latter forms a forward boundary for the merchandise display fixture. As aforementioned, the upper end of each of the arms 14 has a recess 20 formed therein which receive in snug, frictionally held condition, the projecting portion 38*a* on the cross member 38, to thus detachably and frictionally hold the cross member in assembled relationship with arms 14. Cross member 38 is preferably formed of generally spring-like or flexible material, such as for instance, plastic or metal, so that the projecting portion 38*a* of the cross member can be forced downwardly into snug frictionally held relationship with the aforementioned recesses 20 in the ends of the arms, thus detachably holding the cross member 38 in place.

Cross member 38 preferably has a forward rearwardly inclined lip portion 38*b* thereon, which is adapted to receive the lower or forward end of the aforementioned merchandise display deck 16 of the fixture and secure it in position, and as will be hereinafter described in greater detail.

The rear portion of base 12 may be provided with upstanding flanges 42 thereon having rearwardly projecting hooks 42*a* which are adapted to receive in supported relation, the rear standards 44 (FIGS. 1 and 7) forming the rear structure 18 of the merchandise display fixture. Standards 44 are removably supported on brackets 42 in a manner known in the art, and will not be described in greater detail here. Suffice it to say that such standards have elongated slots 44*a* (FIG. 1) formed therein in a manner known, and through which extend the aforementioned hooks 42*a* of associated support bracket 42.

In the embodiment illustrated, the base-arm, and drawer assembly is adapted to be supported on a kickplate structure 46 (FIGS. 1 and 3) which is known in the art and forms no particular inventive part of the present arrangement of fixture. Such kickplate 46 preferably has upstanding coupling flanges 46*a* (FIG. 3) which are adapted to be received in complementary slots 47 (FIG. 5) in the underside of the base platform 12, for positioning and removably retaining the base-arm structure and drawer 36 assembly on the kickplate. It will be seen that the kickplate 46 raises the fixture 10 up off the floor surface for the height of the kickplate, with the base being received thereon in generally snug, aligned relationship, to thus provide a highly stable support for the fixture. In this connection, the forward boundary of the kickplate may also include a raised lip portion 50 (FIGS. 1 and 3) which is adapted to generally abut with the aforementioned front boundary of base 12 of the fixture and thus aid in properly positioning the latter on the kickplate structure.

The rear structure 18 of the fixture 10 may include vertically spaced cross members 52, 52*a* detachably extending between the aforementioned rear standards 44. Cross members 52, 52*a* may be detachably secured in readily removable relation to the standards 44 in a manner known in the art, and with the upper end of the deck portion 16*a* and the upper end of upper deck portion 16*b* being coupled, as by means of the respective associated molded hook portion 54 thereon, to the respective cross member, to support the deck assembly 16 on the rear cross members. The lower end of the molded deck portion 16*a* which may be formed of generally flexible but self supporting molded plastic material is preferably received in a generally V-shaped, in end elevation, elongated retainer member 56, which member 56 may be also formed of molded plastic material. Member 56 is received under the aforementioned lip 38*b* of the cross member 38 supported on the arms 14, and as shown for instance in FIG. 1. The lower flange 56*a* of retainer member 56 is adapted to be received in projecting portion 38*a* of cross member 38, as shown in FIG. 1. Since the deck 16 of the fixture is supported on the rear cross members 54, 54*a*, and on the front wall cross member 38 of the fixture, the deck is maintained in fixed, held position between such supporting structure for receiving thereon merchandise to be displayed.

In this connection, the molded merchandise display deck 16 may include molded recesses 60 (FIGS. 7 and 9) formed therein and opening onto the outer edge of the respective step formed or molded on the deck, with such recesses 60 being adapted to receive divider webs or panels 62 which in the embodiment illustrated have depending flexible legs 62*a* (FIG. 9) formed thereon, for being received in the aforementioned respective recess 60 in the molded deck, to frictionally hold the divider webs in position on the stepped deck portion, to form cubicles which can receive therein the merchandise to be displayed. Divider clips 62*b* may also be provided adapted for frictional clipping onto a respective web for dividing the formed cubicle into a plurality of sections. Divider webs 62 and clips 62*b* are preferably formed of generally clear plastic, so that the merchandise in the respective cubicle can be viewed through the divider web.

Referring now in particular to FIG. 8, it will be seen that there may be provided side panels 63 for the fixture which have slots 63*a* in the rear edge thereof with an interior pin 63*b* extending transversely through the respective of such slot and with the slot being adapted to receive therein a bayonet type coupler bracket 64 which has mounting hooks 64*a* thereon extending generally perpendicular to the plane of the major portion of the bracket, with the hooks 64*a* being adapted to be received in and supported in a pair of vertically spaced slots 66 in the rear standards 44 of the fixture, to thus support the side panels 63 on the fixture to close in the sides thereof. The base may also have one or more openings 68 (FIGS. 5 and 8) therein adapted to receive a bracket 70, for aiding in supporting the weight of the side panel 63 and ensuring its retention to the remainder of the fixture structure.

Referring now in particular to FIGS. 10 through 18 in conjunction with FIG. 4, the aforementioned knock-down drawer structure 36 provides for storing merchandise in the lower part of the fixture preparatory to moving it upwardly to the merchandise display deck, as the latter is cleared of merchandise by sale. Such drawer structure is preferably provided in knock-down condition as shown, with the drawer structure 36 being assembleable with the aforementioned base 12 and swingable arm structure 14, for shipment as a unit, and as shown for instance in FIG. 1.

Such drawer structure 36 in the embodiment illustrated includes a fabricated drawer pan 72 comprising side walls 72*a*, a back wall 72*b*, and a bottom wall 72*c* extending between the side and back walls, to provide the drawer pan structure. Walls 72*a*, 72*b* and 72*c* may be conveniently formed, for instance, of wood or flake board, but may be formed of other materials, and are preferably permanently secured together.

Projecting upwardly from the forward boundary of the drawer pan 72 on the respective side of the drawer pan is a bracket 74, which has hook portions 74*a* projecting forwardly therefrom, and which provide couplers for coupling the front panel 76 of the drawer structure, to the drawer pan. Each bracket 74 may be fastened to the respective side wall 72*a* of the drawer structure, as at 78, by fasteners or any other suitable means.

Figure 11:
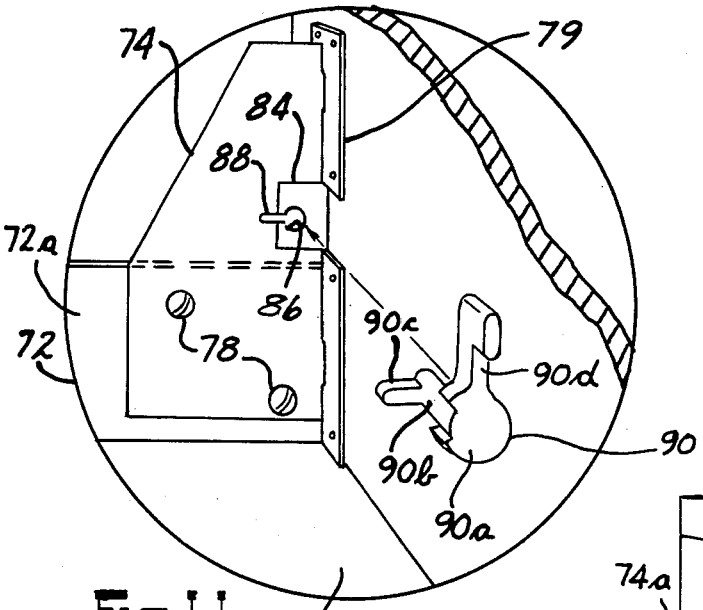
FIG. 11 is an enlarged view of a section of FIG. 10 showing the coaction between the coupling on the rear side of the front panel and the coupling on the drawer pan adapted to receive therein when juxtaposed and aligned a rotatable cam lock, for detachably locking the front panel to the remainder of the drawer structure.
Figure 10:
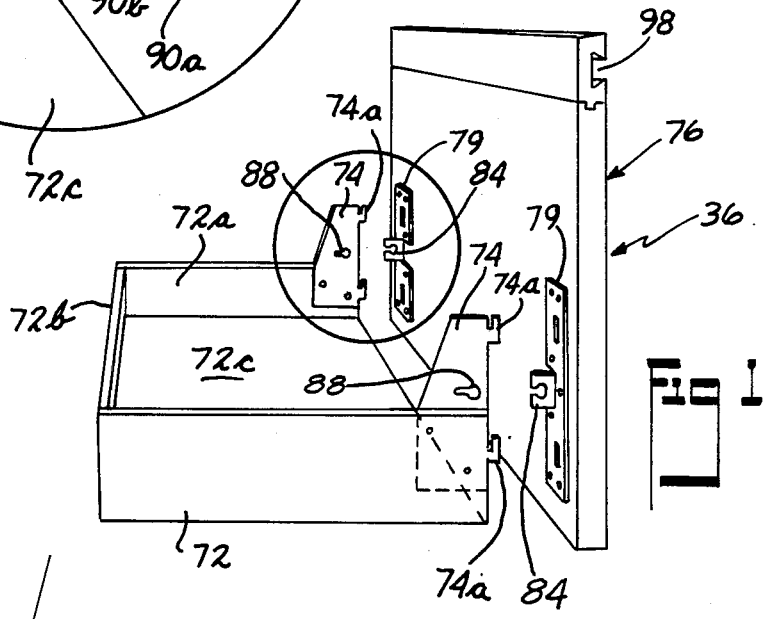
FIG. 10 is an exploded, perspective view of the knock-down drawer, with the front panel detached from the remainder of the drawer pan.
Figure 12:
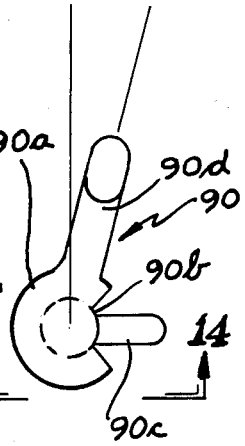
FIG. 12 is an enlarged, side elevational view of the lefthand rotatable cam lock for detachably connecting the front panel of the knock-down drawer to the remainder of the drawer pan.
Figure 13:
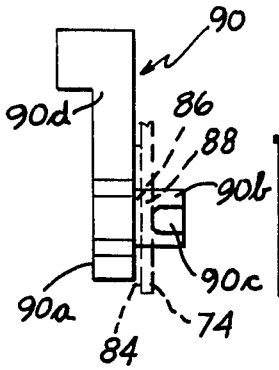
FIG. 13 is a rear end elevational view of the rotatable cam lock of FIG. 12.
Figure 14:
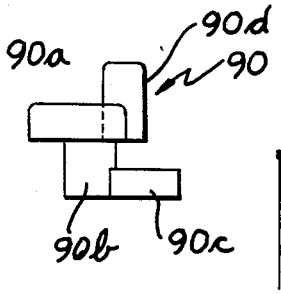
FIG. 14 is a plan view of the rotatable cam lock of FIG. 12 taken generally along the plane 14—14 of FIG. 12, looking in the direction of the arrows.
Figure 16:
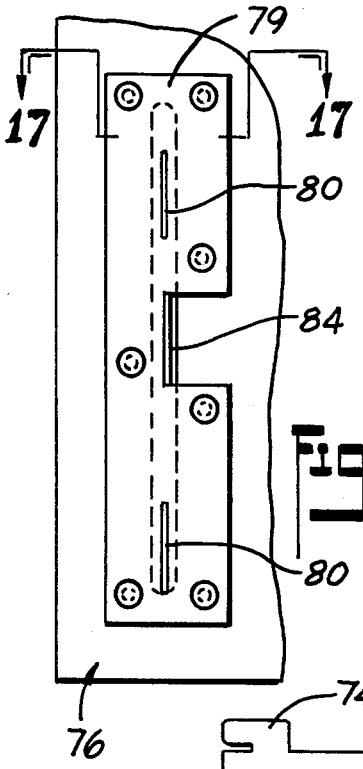
FIG. 16 is a fragmentary, elevational view of the coupling bracket mounted on the right side of the inner surface of the front panel of the drawer structure for coupling the front panel to the remainder of the drawer pan.
Figure 17:
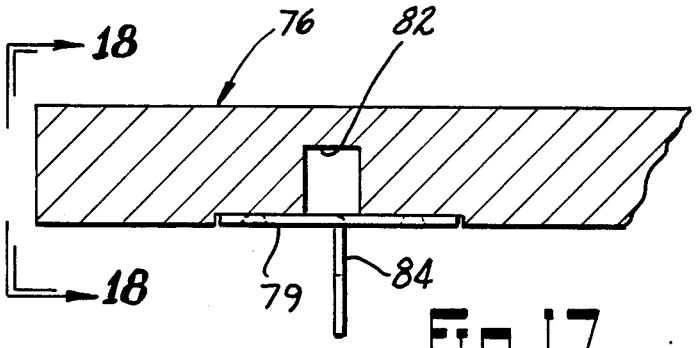
FIG. 17 is an enlarged, sectional view of the front panel taken generally along the plane of line 17—17 of FIG. 16 looking in the direction of the arrows.
Figure 18:
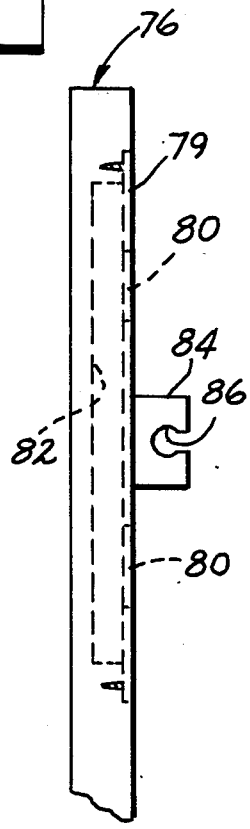
FIG. 18 a fragmentary side elevational view of the front panel showing the recessed nature of one of the coupling brackets on the rear side of the front panel and is taken generally along the plane of line 18—18 of FIG. 17 looking in the direction of the arrows.

The front panel 76 of the knock-down drawer structure includes, on its rear surface, elongated coupling bracket structure 79 and oriented so as to be disposed in generally confronting relationship with respect to the respective coupling bracket 74. Each elongated bracket 79 comprises in the embodiment illustrated a pair of vertically spaced slots 80 therein with the slots communicating in the embodiment illustrated with a recess 82 (FIGS. 16 and 17) formed in the front panel 76. Such recess 82 provides for receiving the associated hook portions 74*a* of the respective coupling bracket 74 through the confronting slots 80 and into the front panel, so that the front panel 76 can be disposed in supported, held relation on the bracket hooks 74*a* and as illustrated in FIGS. 1 and 11. In the embodiment illustrated, the coupling brackets 79 are preferably recessed into the rear surface of the front panel 76 as shown in FIG. 18.

Projecting outwardly and rearwardly from the respective bracket 79 and formed in the embodiment illustrated from a partially severed portion thereof, is a flange or tab 84. Tab 84 in accordance with the invention, has an opening 86 formed therein, with the opening or slot 86 opening onto the rear boundary of tab 84. When the front panel 76 of the drawer assembly 36 is hung on the hook portions 74*a* of bracket 74, the opening 86 in each tab 84 is aligned with and disposed adjacent to a generally key-shaped opening 88 formed in the respective coupling bracket 74.

A rotatable cam lock 90 (FIGS. 11–14) is adapted to be received through the aligned and registered openings 86, 88, and then rotated so as to releasably lock the front panel 76 to the drawer pan, thus forming the drawer structure and specifically the front thereof.

Cam lock 90 is provided in the form of a lefthand member and a righthand member, with the lefthand and the righthand members being mirror images of one another. Each cam lock member 90 comprises a body portion 90*a*, an arm portion 90*b* extending laterally from the body portion, a finger portion 90*c* projecting generally perpendicularly from the arm portion, and a handle portion 90*d* projecting outwardly from the body portion, and as illustrated in aforementioned FIGS. 11–14.

After the arm portion 90*b* and associated finger portion 90*c* of the cam lock 90 is received through the respective aligned and registered openings 86, 88 in the associated tab 84 and bracket 74, the lock member 90 may then be rotated downwardly, by means of the handle portion 90*d*, whereby the bracket 74 and tab 84 on respectively the drawer pan and the rear side of the front panel 76 are held in interlocked relation between the projecting finger 90*c* and the spaced body portion 90*a* (FIG. 13) to lock the front panel 76 to the remainder of the drawer structure.

It will be seen that by providing for ready detachment of the front panel 76 from the remainder of the drawer structure, and by providing for ready re-attachment thereof to the drawer structure, the shipment of the pan portion of the drawer structure with and on the aforementioned base 12 and pivotal arm support structure 14 is facilitated, with the front panel being able for instance, to be stacked in with the drawer pan structure for shipment purposes with the arms 14 being located in fold-down condition. Upon arrival at the site of use of the fixture, the front panel 76 can be readily and quickly assembled with the remainder of the drawer structure to provide the finished drawer, ready to store merchandise.

Figure 15:
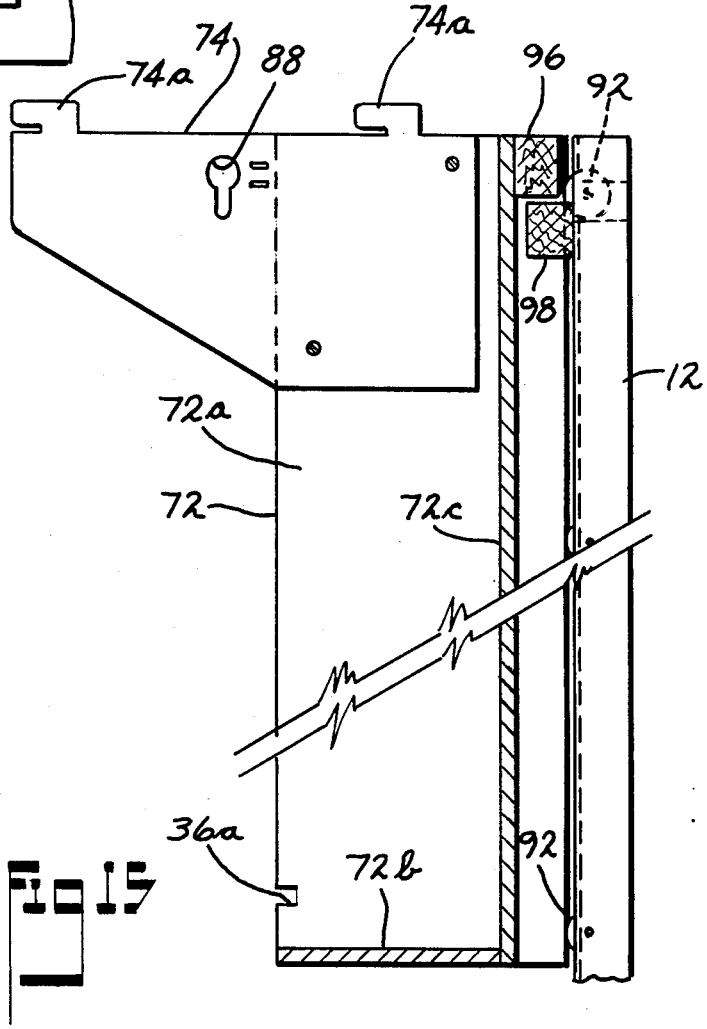
FIG. 15 is a sectional view of the knock-down drawer structure and its position on the base of the fixture, but rotated 90° from its normal horizontal position.

Referring now in particular to FIGS. 4 and 15, in the embodiment illustrated, the drawer structure 36 is preferably mounted upon rollers 92 to facilitate its movable relationship with respect to the base 12, with the rollers 92 being rotatably mounted in recesses 94 formed in the base 12. The rollers 92 facilitate the smooth slidability of the respective drawer with respect to the fixture and enhance the desirability of the fixture. A stop 96 may be provided on the underside of each drawer 36 structure adapted for engagement with a stop 98 mounted in confronting relationship on the base 12 (FIG. 15) so as to limit the inward movement of the drawer relative to the base. As can be best seen in FIG. 1, in the operative assembled condition of the fixture, the front panel 76 of the drawer is adapted to be received beneath the cross member 38 extending between the arms 14, with the upper end of the front panel being preferably provided with a recess 98 therein for use as a handle gripping portion, for opening and closing the respective drawer.

From the foregoing description and accompanying drawings it will be seen that the invention provides a novel knock-down merchandise display fixture having a base with generally vertically extending arms mounted in coupled relation to the base, adjacent the forward boundary thereof and adapted to normally extend upwardly relative to the base, with such arms being adapted to provide structural support for the merchandise display deck of the fixture, and including means providing for selective folding or downward swinging of the arms relative to the base for decreasing the overall height of the base and arms, thus facilitating shipment of certain components of the fixture as a unit.

Moreover, the invention provides a knock-down drawer structure for use with the fixture, which facilitates the shipment of the component parts of the fixture as a unit, and which enables the drawer structure to be rapidly and expeditiously assembled and/or disassembled, for shipment of the fixture to its site of use, while providing the convenient movement of the fixture from one location to another location if that becomes necessary or desirable. The fixture is adapted to be generally rapidly assembleable and disassembleable utilizing relatively unskilled labor and a minimum of auxiliary fastening devices.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

We claim:

1. In a knock-down merchandise display fixture comprising a base having a pair of forwardly disposed generally vertically extending laterally spaced arms mounted in coupled relation to said base adjacent the forward boundary of the base and extending upwardly relative to said base, and a removable merchandise display deck adapted for receiving merchandise thereon, and having an upper end and a lower end, said arms being adapted to provide structural support for said merchandise display deck of said fixture, and means coacting between said arms and said base providing for selective folding of said arms relative to said base for decreasing the overall height of said base and arms for facilitating shipment of said fixture, a cross member supported on said arms and extending transverse of said base and between said arms, to define the generally forward boundary of said fixture, and means on said cross member coacting with said lower end of said deck and providing structural support in detachable relation for said lower end of said merchandise display deck of said fixture relative to said arms and said cross member, to enable said selective folding of said arms relative to said base.

2. A fixture in accordance with claim 1 wherein said means providing for foldably mounting said arms to said base comprises an upstanding web generally adjacent said forward boundary of said base, said web being of a materially lesser height as compared to the height of the respective arm and having a projection mounted thereon which extends laterally thereof, said arm being disposed adjacent said web and having a slot formed therein complementary to said projection and receiving the latter therein, and having a headed pivot projection thereon extending laterally through a vertically elongated slot in said web, said arm upon predetermined vertical movement thereof relative to said web causing movement of said headed pivot projection upwardly in the second mentioned slot and moving the first mentioned slot upwardly out of coacting relationship with said projection on said web, whereby said arm can then be swung downwardly relative to said base to decrease said overall height of said base and arms.

3. A fixture in accordance with claim 1 wherein said arms at the upper ends thereof include recess means opening onto the exterior periphery of the respective arm in the lengthwise direction of the respective arm and receiving and retaining said transverse cross member in supported and removably held relation on said arms.

4. A fixture in accordance with claim 1 including rollers mounted on said base and receiving thereon a drawer below said deck for rollable movement on said base.

5. A fixture in accordance with claim 1 wherein said base on the rearward end thereof includes means for supporting vertically arranged standards, and said deck extending between said standards and said cross member on said arms for providing cubicles for merchandise to be displayed, the weight of said deck being supported on said arms and on said standards.

6. A fixture in accordance with claim 2 wherein said arm includes a generally arcuate guide surface adjacent the lowermost end thereof, movably engageable with said projection on said web during downward swinging movement of said arm relative to said base, to aid in guiding the movement of said arm toward its reposed position relative to said base.

7. A fixture in accordance with claim 2 wherein said arm is formed from sheet-like material and comprises end flanges for rigidifying said arm.

8. A fixture in accordance with claim 4 including guides on the top side of said base adapted to be received within complementary guides on the underside of said drawer, for guiding the rolling movement of said drawer relative to said base, and including stop means on said base for limiting inward movement of said drawer relative to said base.

9. A fixture in accordance with claim 2 wherein said first mentioned slot opens to the lower end of said arm for providing for movement of the first mentioned projection out of coaction with said first mentioned slot upon said predetermined vertical movement of said arm relative to said web.

10. A fixture in accordance with claim 4 wherein said drawer includes a pan structure and a removable front panel, and mounting means on said drawer pan structure for detachably mounting said front panel thereon.

11. A fixture in accordance with claim 10 including locking means attached to the backside of said front panel and invisible from the front side of said panel, for locking and unlocking said panel to said drawer pan structure.

12. A fixture in accordance with claim 11 wherein said locking means comprises a rearwardly projecting bracket on said backside of said front panel, said bracket being disposed in a generally vertical plane and having an open ended slot therein communicating with the distal end of said bracket, and a key-hole shaped opening in said mounting means disposed in registration with said slot, and a rotatable locking cam separable from said bracket and said mounting means and passing through said opening and said slot and being rotated into locking position to prevent withdrawal movement of said front panel from said pan structure, thus locking said panel to said pan structure, said locking cam being rotatable to a position relative to said slot and said opening whereby it can be moved laterally relative to said bracket and said mounting means for withdrawing said cam from coaction therewith and thus permit separation of said front panel from said pan structure.

13. In a knock-down merchandise display fixture comprising a base having a pair of forwardly disposed generally vertically extending laterally spaced arms mounted in coupled relation to said base adjacent the forward boundary of the base and extending upwardly relative to said base, and a merchandise display deck having upper and lower ends, and adapted for receiving merchandise thereon, means coacting between said arms and said base providing for selective folding of said arms relative to said base for decreasing the overall height of said base and arms for facilitating shipment of said fixture, a cross member supported on said arms and extending transverse of said base between said arms to define the generally forward boundary of said fixture and to provide structural support for said deck, and wherein said cross member includes a rearwardly and upwardly projecting lip thereon adapted to receive therein the lower end of said deck to retain such lower deck end in assembled relationship with said cross member.

14. A drawer capable of being shipped, in a knocked-down condition and later assembled and installed for use in a display fixture, said drawer including a pan structure adapted to be slidably mounted in said fixture, planar-like brackets disposed in generally vertical planes generally parallel to the longitudinal plane of said pan structure extending upwardly from said pan structure adjacent the forward end thereof, said brackets having coupling means thereon, a removable front panel for said drawer structure, said front panel including coupling means on the inner side thereof adapted for coacting with the first mentioned coupling means for removably mounting said front panel on said brackets, and means coacting between said front panel and said brackets for detachably securing said front panel to said brackets, the last mentioned means including a tab disposed in a generally vertical plane and projecting rearwardly from the inner side of said front panel, said tab having an opening therethrough which is adapted for alignment with a complementary opening in the respective of said brackets when said front panel is disposed in said mounted condition on said first mentioned coupling means, said securing means also including a rotatable cam lock member insertable laterally of said bracket and tab through said aligned openings in said bracket and said tab and then rotatable into a locking position to interlock said bracket and tab together, thus preventing disassembly of said front panel from said pan structure.

15. A drawer in accordance with claim 14 wherein said cam lock member comprises a body portion and an arm portion extending laterally from said body portion, a finger portion projecting generally perpendicular to said arm portion, and a handle portion projecting from said body portion, said finger and arm portions being adapted to be received through said aligned complementary openings in said coupling means, and upon rotation of said cam lock member, positioning said finger portion relative to said openings to prevent withdrawal of said cam lock member from said aligned openings.

16. A drawer in accordance with claim 14 including strip-like brackets mounted on said inner side of said front panel and comprising the second mentioned coupling means, each of said strip-like brackets comprising an elongated member of generally rigid sheet material having slots therein spaced vertically with respect to one another, said tab being disposed intermediate said slots and projecting laterally of said elongated member including an opening formed therein generally complementary to an opening in the respective of said brackets on said pan structure, the second mentioned opening comprising said first mentioned coupling means, and being adapted for registration with the first mentioned opening upon assembly of said front panel to said pan structure, whereby said cam lock member can be passed through said aligned registered openings and rotated to detachably lock said front panel to said pan structure.

17. A drawer in accordance with claim 16 wherein said cam lock member includes a pair of said members, one of which is adapted for assembly with bracket and tab structure of the lefthand side of said drawer and the other of which is adapted for assembly with other bracket and tab structure on the righthand side of said drawer, to detachably lock said front panel to said pan structure, said righthand cam lock member being a mirror image of said lefthand cam lock member.

18. A drawer with a removable front panel comprising a drawer pan having mounting means including a generally planar bracket, for mounting a panel on the front thereof, a front panel removably secured to said drawer pan, and fastening means coacting between said drawer pan and said panel releasably securing said front panel to said pan, said fastening means comprising a rotatable cam member which is adapted to pass through complementary openings on said panel and on said pan for detachably securing said panel to said pan, said fastening means also including a generally planar tab attached to the inner side of said panel in rearwardly projecting relation therefrom and oriented in generally juxtaposed condition to said bracket in the mounted condition of said panel on said pan, said complementary openings being located in said bracket and said tab and being registered with one another to receive therethrough from laterally of the coacting bracket and tab said rotatable cam member, thus preventing disassembly of said panel from said pan.

19. In a knock-down merchandise display fixture comprising a base having generally vertically extending laterally spaced arms mounted in coupled relation to said base adjacent the forward boundary of the base and extending upwardly relative to said base, said fixture including rear structure extending upwardly relative to said base and a merchandise display deck having an upper end and a lower end, and adapted for receiving merchandise thereon, said arms being adapted to provide strutural support for said merchandise display deck of said fixture, and means coacting between at least one of said arms and said base providing for selective folding of said one arm relative to said base for decreasing the overall height of said base and said one arm for facilitating shipment of said fixture, a cross member supported on said arms and extending transverse of said base between said arms to define the generally forward boundary of said fixture and to provide structural support for said lower end of said deck, said merchandise display deck extending from said rear structure of said fixture to said front cross member thereof, said deck including means detachably securing it to said rear structure and means detachably securing it to said cross member for rapid assembly and disassembly of said deck to and from said fixture.

20. A fixture in accordance with claim 19 wherein said deck is of molded plastic and defines a plurality of steps adapted to receive merchandise to be displayed, each of said steps having means adapted for slip-fit assembly with divider wall means for providing recesses for receiving merchandise therein.

21. In a knock-down merchandise display fixture comprising a base having a pair of forwardly disposed generally vertically extending laterally spaced arms mounted in coupled relation to said base adjacent the forward boundary of the base and extending upwardly relative to said base, and a removable merchandise display deck adapted for receiving merchandise thereon, said arms being adapted to provide structural support for said merchandise display deck of said fixture, and means coacting between each of said arms and said base providing for selective folding of said arms relative to said base for decreasing the overall height of said base and arms for facilitating shipment of said fixture, a cross member supported on said arms and extending transverse of said base and between said arms to define the generally forward boundary of said fixture and to provide structural support for said display deck of said fixture, a drawer slidably mounted on said base and adapted for movement inwardly and outwardly relative to said base to close and to open said drawer, and means on said cross member coacting with means on said drawer in the folded condition of said arms relative to said base for maintaining said drawer in closed condition and assembled relationship with said base, during shipment of said fixture.

22. A fixture in accordance with claim 21 wherein the last mentioned means comprises a slot in the upper surface of a side wall of said drawer and said means on said cross member comprises a tab portion on the rearward end of said cross member, received in said slot so that said tab portion is engageable with a defining wall of said slot to restrain said slidable drawer against opening movement relative to said base.

* * * * *